US005671913A

United States Patent [19]

Vesper

[11] Patent Number: 5,671,913

[45] Date of Patent: Sep. 30, 1997

[54] FENCE WALL CONSTRUCTION WITH DECORATIVE FACING

[76] Inventor: Dale E. Vesper, 9439 Linden Rd., Fenton, Mich. 48430

[21] Appl. No.: 835,241

[22] Filed: Feb. 12, 1992

Related U.S. Application Data

[63] Continuation-in-part of Ser. No. 178,261, Apr. 6, 1988, Pat. No. 5,184,808, and a continuation-in-part of Ser. No. 455,061, Dec. 22, 1989, Pat. No. 5,129,628, and a continuation-in-part of Ser. No. 535,933, Jun. 11, 1990, abandoned.

[51] Int. Cl.[6] ..... E04H 17/16

[52] U.S. Cl. ..... 256/31; 256/73; 256/DIG. 5; 256/24; 52/790.1; 52/309.7; 52/281

[58] Field of Search ..... 256/24, 19, 31, 256/73, DIG. 5, 25–28; 52/387, 386, 384, 314, 556, 241, 239, 656, 582, 309.9, 309.11, 309.7, 309.17

[56] References Cited

U.S. PATENT DOCUMENTS

| | | | |
|---|---|---|---|
| 2,039,601 | 5/1936 | London | 52/779 X |
| 3,131,514 | 5/1964 | Siek | 52/384 X |
| 3,304,683 | 2/1967 | Ferreira | 256/24 X |
| 3,381,483 | 5/1968 | Huthsing, Jr. | 256/19 X |
| 3,600,864 | 8/1971 | Godley | 52/314 X |
| 3,646,715 | 3/1972 | Pope | 52/309.9 |
| 4,011,702 | 3/1977 | Matyas | 52/387 |
| 4,154,030 | 5/1979 | Huguet | 52/241 X |
| 4,241,554 | 12/1980 | Infantino | 52/314 |
| 4,567,699 | 2/1986 | McClellan | 52/241 X |
| 4,712,352 | 12/1987 | Low | 52/809 |
| 4,716,692 | 1/1988 | Harper et al. | 52/241 X |
| 4,809,470 | 3/1989 | Bauer et al. | 52/387 X |
| 4,896,469 | 1/1990 | Wright | 52/241 X |
| 4,987,712 | 1/1991 | Mancuso | 52/387 |
| 5,006,011 | 4/1991 | Hiyashi | 52/387 X |

FOREIGN PATENT DOCUMENTS

| | | | |
|---|---|---|---|
| 96641 | 8/1960 | Norway | 256/24 |
| 241634 | 10/1925 | United Kingdom | 52/779 |

*Primary Examiner*—Harry C. Kim
*Attorney, Agent, or Firm*—Charles A. McClure

[57] ABSTRACT

Fence walls comprising flanged supporting posts spaced on centers and uniform lightweight panels doubly slotted at their ends fitting between adjacent posts and engaging such flanges. The engaged post flanges are substantially concealed from view. At least one face of such panels is grooved horizontally so as to accommodate facing brick or other decorative material. Any ungrooved face of the panels may be covered with stucco or like cementitious material, preferably containing elastomeric and lightweight bulking ingredients, as well as desired coloring.

1 Claim, 3 Drawing Sheets

FENCE WALL CONSTRUCTION WITH DECORATIVE FACING

This is a continuation-in-part of my applications, (i) Ser. No. 178,261 filed 6 Apr. 1988, U.S. Pat. No. 5,184,808; (ii) Ser. No. 455,061 filed 22 Dec. 1989, U.S. Pat. No. 5,129,628; and (iii) Ser. No. 505,933 filed 11 Jun. 1990, now abandoned; all of which are incorporated herein by this reference.

TECHNICAL FIELD

This invention relates to construction of fence walls, as for physical and visual separation of adjacent sites, and concerns particularly increased durability and increased economy of such walls provided with brick or other ceramic facing on a lightweight panel.

BACKGROUND OF THE INVENTION

Most concrete block fence walls, look fine when just installed. However, many tilt, sag, and crack as time passes and the underlying support shifts under the weight of the materials used, often after seasonal freezing and thawing, as well as from inevitable exposure to storms and high winds. Hence, means and methods of construction suitable for interior walls of buildings are generally out of place outdoors. Nor is the opposite extreme of making walls of reinforced concrete on massive footings an appropriate answer for fence walls subjected mainly to the foregoing natural hazards.

Some innovators have made contributions toward meeting the continuing need for more durable fence wall structures. Thus, Cochrane in U.S. Pat. No. 2,664,740 discloses I-beam posts with hardware to retain his panel members. Totten in U.S. Pat. No. 4,007,919 teaches hollow I-beam posts with interlocking hollow rails filled with plastic. Kavanaugh in U.S. Pat. No. 4,288,962 discloses a wall made by affixing plasterboard to the exterior of aligned flanges (perforated) of metal I-beams, and spraying plastic foam to coat the adjacent surface of such board and flanges until flush, and finally coats the exterior with adhesive and then with stucco.

The present inventor has provided a new reinforced lightweight wall panel, and fence walls containing such panels, as disclosed in his patent applications mentioned above, wherein some of the foregoing and other patents were cited—and were shown to be different.

Brick walls are particularly susceptible to deterioration with age, for the general reasons already mentioned, and also because an individual brick may become dislodged and fall to the ground, with unsightly results. Embedding brick in concrete or using elastomeric additives are not an answer. Bauer in U.S. Pat. No. 4,809,470 discloses a polymeric foam panel with an overlay adapted to hold brick courses on a building facade, and Harper et al. U.S. Pat. discloses non-load-bearing locking strips for use between vertical edges of adjacent interior panels, but they cannot provide the novel combination of desirable features of my invention described and illustrated below.

SUMMARY OF THE INVENTION

In general, the objects of the present invention are met by placing a plurality of flanged fence posts upright and on centers spaced apart at successive intervals, by providing a plurality of wall panels of such interval length with slots along their vertical side edges, and inserting successive panels between adjacent pairs of such posts with such flanges received antirely within such slots.

The panels are recessed or grooved in multiple horizontal bands spaced apart vertically along at least one face to receive courses of ceramic or other facing material, such as brick or other decoration. The panels also preferably are doubly slotted along their top and/or bottom edges (slightly offset from the side edge slotting) so as to receive rigid reinforcing channel members therein.

A primary object of this invention is to provide an extremely durable fence wall faced with brick or other decorative material.

Another object of the invention is to combine decorative appearance, light weight, and material strength in a fence wall.

A further object is to provide a homogeneous lightweight panel useful in fence walls in unreinforced or reinforced condition.

Yet another object of the invention is to reinforce such panels by insertion of substantially rigid top and/or bottom channels.

A still further object is to accomplish the foregoing objects more economically than lesser results are attained nowadays.

Other objects of this invention, together with means and methods for attaining the various objects, will be apparent from the following description of the invention and from the accompanying diagrams presented by way of example rather than limitation.

DESCRIPTION OF THE INVENTION

Figure 1:
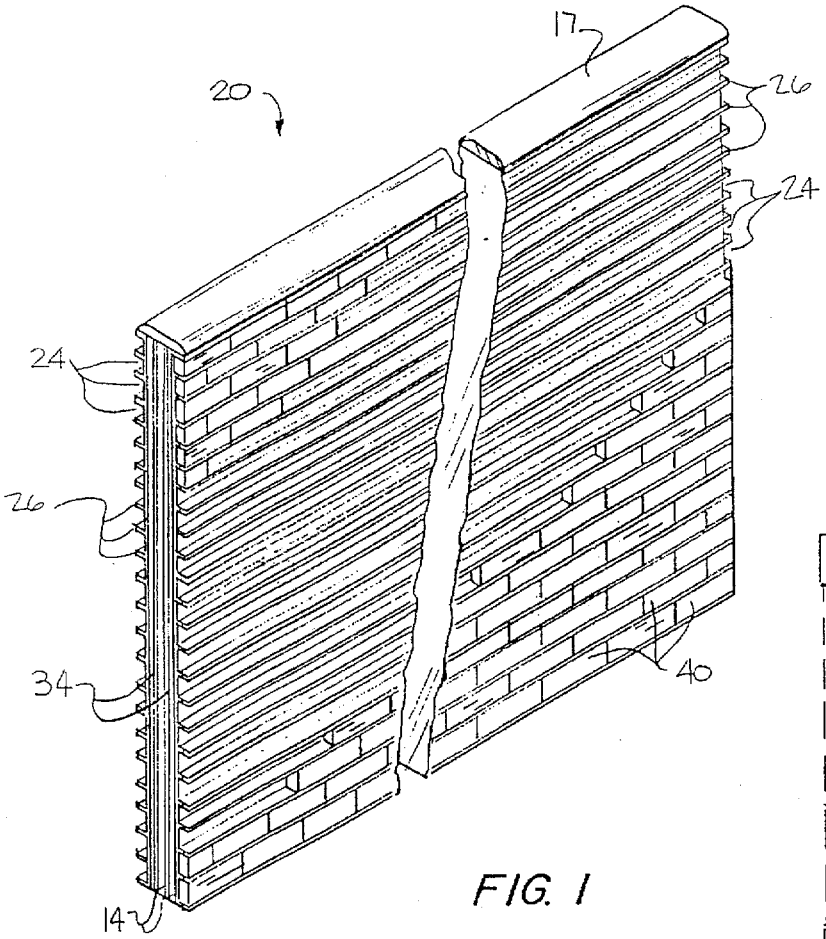
FIG. 1 is a fragmentary perspective view of a first embodiment of fence wall of this invention, shown at an intermediate stage in its installation.

FIG. 1 shows, in perspective, fence wall panel 20, apart from its surroundings, at an intermediate stage in its installation.

This panel is rectangular endwise, planwise, and sidewise, having its side faces recessed in parallel horizontal grooves 24 between ledgelike land portions 26. The grooves are just deep enough to accommodate half the depth or thickness of individual bricks 40, some being shown installed therein.

The vertical side edge nearest the viewer has pair of parallel slots 14 from its bottom to its top to accommodate flanges of a supporting post—not shown in this view. An intermediate length portion of the wall panel is omitted here.

Figure 2:
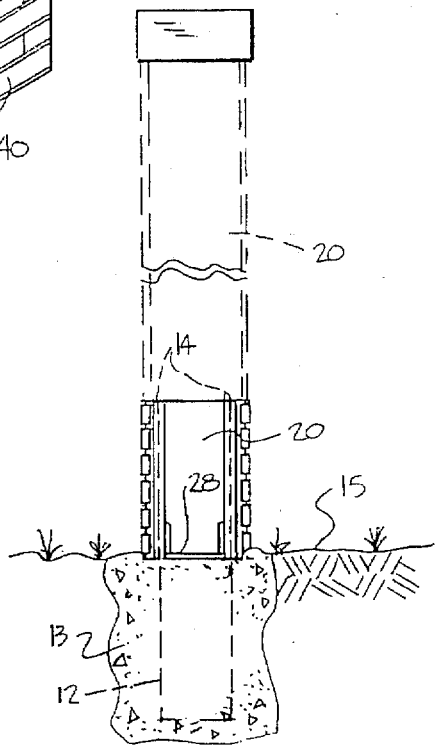
FIG. 2 is a fragmentary transverse sectional elevation of such fence wall taken in the vicinity of a supporting post.

FIG. 2 shows fence wall 10 in fragmentary transverse elevation (and partial section) featuring wall panel 20 with bricks installed on both sides, and cap 17 added on top. Upright H-beam or I-beam post 12 (in broken lines) extends from within underground footing 13 to ground level 15 and upward along a vertical edge of the panel to its top just under the top cap. Pair of slots 24 (broken lines) in the vertical edge of the panel accommodate post flanges (not shown here). Channel 28 embedded in the bottom edge of the panel extends along the panel bottom at ground level and rests on the footing.

Figure 3B:
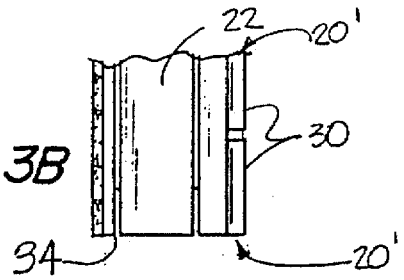
FIG. 3B is a fragmentary top plan view of an end portion of fence wall of FIG. 3A, less post.
Figure 3A:
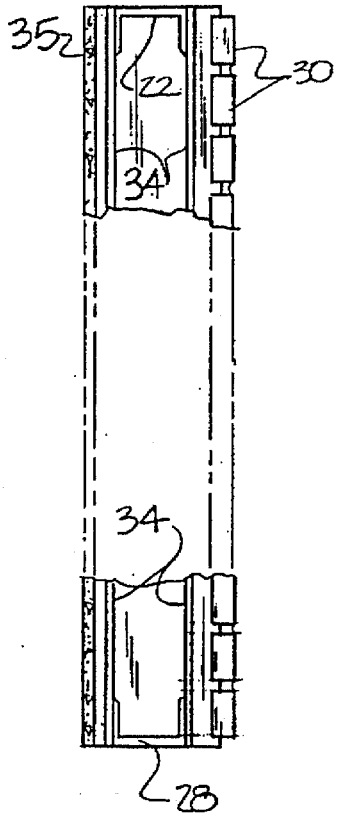
FIG. 3A is a transverse sectional elevation of a similar fence wall embodiment at a post location, but without showing a post.

FIGS. 3A and 3B show on a larger scale, in end view and corner plan, respectively, wall panel 20'—which differs from wall panel 20 by being horizontally recessed in vertically spaced bands to accommodate brick or similar decorative facing on one face, leaving the opposite face smooth to accommodate stucco instead. Oppositely oriented vertical side edges (one visible) have pair of slots 34 flanking a tenon therebetween. Reinforcing channel 22 lies along the top edge of the panel, and like inverted reinforcing channel 28 lies along the bottom edge, with the channel flanges in accommodating grooves or slots (not distinct here) in the corresponding edges. The reinforcing channels preferably are adherent to the panels, or made to be so, as by adhesive, dielectric heating, or the like.

Figure 4B:
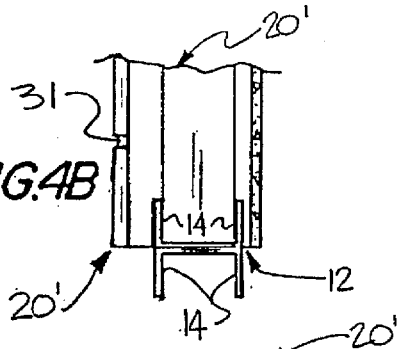
FIG. 4B is a fragmentary plan of an opposite end portion of the fence wall of FIG. 3B, with post.
Figure 4A:
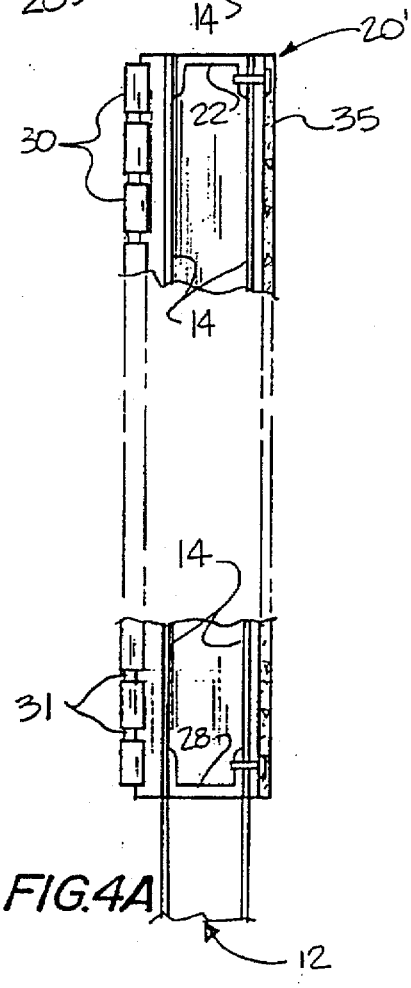
FIG. 4A is a transverse sectional elevation of the fence wall of FIG. 3A viewed oppositely (mirror image) and with a post present.

FIGS. 4A and 4B, show panel 20' with courses of brick 30 on one side and stucco 35 on the other, much like panel 20' of FIGS. 3A and 3B, but viewed from the previous far side, and with flanges 14 of post 12 present in slots 28 in the vertical edges of the panel. It will be apparent from FIG. 4B that the post flanges fit concealed within such vertical side edge slots just outside—sandwiching—the ends of the flanges of the respective reinforcing channels.

Figure 5:
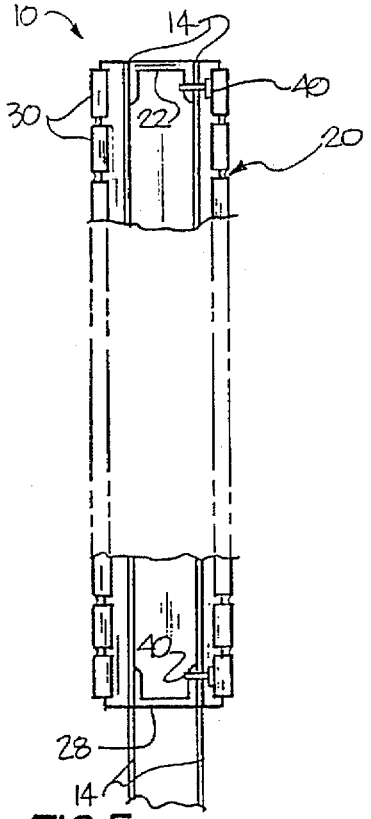
FIG. 5 is a fragmentary end elevation of fence wall embodiment similar to that of FIGS. 1 and 2.

FIG. 5 shows fence wall 10 with panel 20 of FIGS. 1 and 2 and post 12 present, with post flanges 14 accommodated in the vertical edge panel slots as in FIG. 4. Moreover, here screws 40, one at the top and two at the bottom, secure a flange of respective top and bottom reinforcing channels 22 and 28 to a flange 14 of post 12. Hardly noticeable here and in succeeding views on this scale is that a bead of caulking 31 overlies each land 26 between adjacent brick courses (and adjacent brick ends in each course, as shown later).

Figure 6:
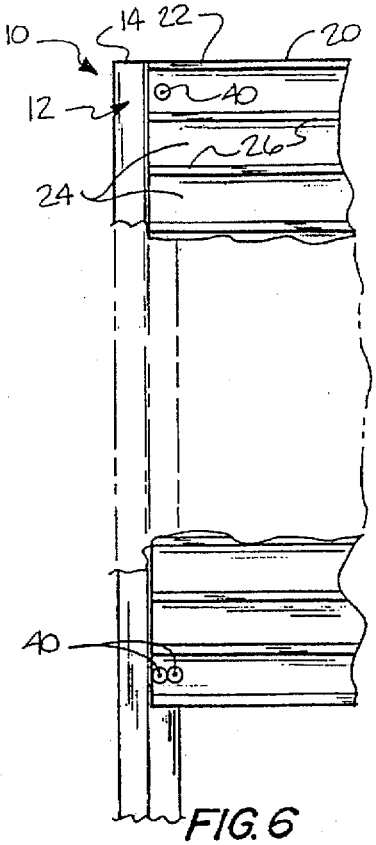
FIG. 6 is a fragmentary side elevation of a fence wall panel of FIGS. 1, 2, and 5 (without facing) tacked to a supporting post.

FIG. 6 shows fence wall 10 with panel 20 from the side, at the post location shown edge-on in FIG. 5. However, here the brick facing has been omitted to show the heads of securing screws 40, one at the top and two at the bottom as before.

Figure 7:
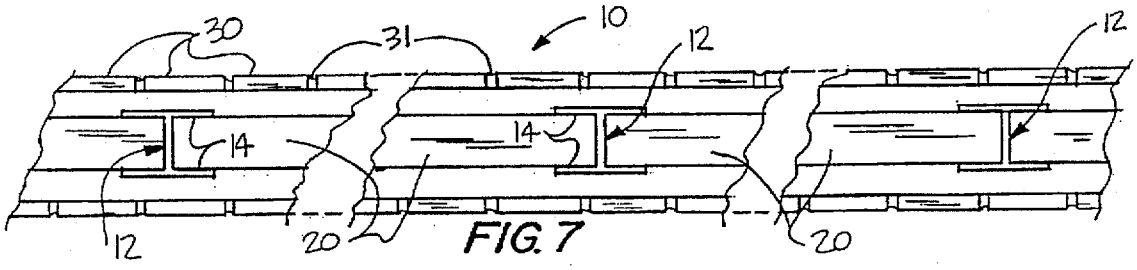
FIG. 7 is a small plan view of a fence wall of this invention.

FIG. 7 shows from above, on a reduced scale, fence wall 10 with several panels 20 supported by intervening posts 12. This view is taken in the absence of a top cap and shows flanges 14 of the posts centered in-line, spaced a single-panel's length apart, and engaging the doubly slotted vertical edges of the panels.

Construction of a fence wall with ceramic facing by means of the grooved panels of this invention is readily understood. Post holes are dug in the ground spaced on centers equal to the panel length. Posts are emplaced upright in footings poured around their bases in the respective post holes. A panel is slid down between each pair of adjacent posts, until its bottom reinforcing channel flange rests directly on the footings or on a metal pin inserted between post flanges just above the footings for a more precise level. Each panel preferably is secured in place by driving self-tapping screws or equivalent fasteners into the parts of the post flanges closely overlapping the end parts of the panel-reinforcing flanges.

One way to apply the brick or other ceramic facing is to daub adhesive in the panel grooves or on the back of the brick (or both) and then to press the brick in the grooves—spaced a bit lengthwise (horizontally) to simulate conventional brickwork. The brick may be provided in advance with a pressure-sensitive adhesive backing, if desired. Then a caulking gun or equivalent device is used to lay a bead of caulking compound along the lands between the brick courses and between ends of adjacent brick within each course.

The materials used in construction of such fence walls of this invention are all conventional and are readily available in the marketplace. Facing bricks are common articles of commerce, measuring about ½ inch thick, 2 inches high, and 6 inches long. Other brick may be used, or tile or other ceramic may be substituted.

The panels are wholly of suitable foamed polymeric composition, such as expanded polystyrene or polyurethane. Their face grooves and edge slots are preferably formed during manufacture by molding or extrusion, but they may be formed afterward, as by milling.

The preferred flange-accommodating double slots—whether in vertical side edges for the post flanges or in horizontal top or bottom edges for reinforcing channel flanges-are parallel and are spaced a given distance apart (less than the panel thickness). The slots extend to given depths sufficient to accommodate the extent of the respective flanges, less for the reinforcing channel flanges and more for the post flanges, from the edges slotted thereby. The slots begin at locations spaced inward from the panel faces, preferably equidistant therefrom and from the edge centerline.

Panels may be various sizes, such as 4 feet high, 8 feet long, and from about 4 inches to about 6 inches thick. Their face grooves are enough shallower than the facing material, especially if brick, to accommodate a bead of silicone or similar caulking simulating mortar between courses and between adjacent brick edges within courses.

The customary caps are made of similar (preferably unfoamed) polymer, or they may be made of stone or other appropriate material. If light in weight they are fastened suitably to the wall panels or to the posts, whereas if they are heavy they may rest on mortar. Decorative horizontal or vertical extensions (strips or pilasters) of similar material may be added as well to modify the wall outline.

The stucco is basically a low-alkali portland cement plus a sub-protective material. Suitable is a cementitious grout, with a substantial part of elastomeric polymer, such as a vinyl-acrylic or an epoxy resin, preferably reinforced by fibrous material mixed thereinto, such as glass or polyalkylene fibers. Also desirable is an expansible siliceous or other mineral aggregate effective to lower the overall density. A base coat is applied to the wall panels either directly or over reinforcing open-mesh fabric of metallic wire, glass, or polymeric composition tacked in place over the panel face. Usually a finish coat colored and similarly or otherwise formulated as desired is applied over the base coat.

The reinforcing channels are usually metallic and may be installed in top and/or bottom slots as part of panel manufacturing or on a fence wall construction site, whether adhesively or otherwise, as by dielectric heating to bond the channel(s) to the panel. The screws or similar fasteners to secure overlapping channel flange and post flange preferably are made of steel, with self-tapping threads.

The supporting posts are conveniently metallic. Such posts, usually galvanized steel, are suitable in 18 gauge up to about 6 feet in fence height and 10 feet in post length (including underground portion), and in suitably heavier gauges (such as 8 to 16) to about 10 feet high and 16 feet long, dependent upon soil type and wind velocity as well as fence height. The base of each post is embedded in a cylindrical concrete footing about a foot in diameter.

In overall appearance, the fence walls of this invention are as attractive as those made in any other way. They require much less maintenance because they do not crack in the manner of concrete block walls. The bottom reinforcing channel bears substantially the panel weight between posts, and the posts support the ends of adjacent panels on footings massive and extensive enough not to shift.

Fence walls of this invention may be made to follow the grade or may bridge swales, culverts, or like gaps horizontally. If on a grade, the bottom edges of the wall panels preferably are supported at like levels by the footings of the posts and/or by appropriate means affixed to the posts at the desired level.

Fence walls of this invention meet customary requirements for wall impact strength, wind resistance, and related physical characteristics, and have been approved by many authorities, especially in the southeastern states, where high winds and waters, and strong sun exposure, impose unusually severe demands.

Although only an in-line arrangement of wall panels and posts is illustrated, it is readily apparent that constructions including corner posts and/or expansion-joint posts are similarly feasible.

Although only horizontal grooving of panel faces is disclosed, the faces may be grooved or otherwise recessed in other directions and be faced or inlaid with diverse materials, whether in linear or other decorative patterns.

Variants on the basic fence wall structure of this invention have been suggested above. Other modifications made be made, as by adding, combining, or subdividing parts or steps while retaining some of the advantages and benefits of the invention, which itself is defined in the following claims.

I claim:

1. An improved fence wall, comprising, upright supporting posts with bases underground located on centers spaced apart by a given wall panel width, each post having at least one pair of parallel vertical flanges adapted to engage vertical side edges of wall panels to be supported thereby;

an upright wall panel per pair of posts, having slotted vertical side edges adapted to be engaged by the post flanges, and having substantially horizontal top and bottom edges extending between their pairs of slotted vertical side edges with a pair of slots therein to a given depth equidistant from the horizontal center-line of the edge and spaced apart at their outermost extent by less than the given thickness of the panel, and having intervening vertical faces recessed to accommodate facing pieces; and a multiplicity of facing pieces applied to at least one of the vertical faces, and accommodated within the recessing thereof.

* * * * *